United States Patent [19]

Böttcher et al.

[11] Patent Number: 4,509,295

[45] Date of Patent: Apr. 9, 1985

[54] CONTROLLED GRINDING OF ROLLERS FOR ELIMINATION OF CRACKS

[75] Inventors: Wolfgang Böttcher, Schwerte-Ergste; Heinz Jüttner, Dortmund; Albrecht Maurer, Dortmund; Ferdinand Stutzinger, Dortmund, all of Fed. Rep. of Germany

[73] Assignee: Estel Hoesch Werke Aktiengesellschaft, Dortmund, Fed. Rep. of Germany

[21] Appl. No.: 359,225

[22] Filed: Mar. 18, 1982

[30] Foreign Application Priority Data

Apr. 1, 1981 [DE] Fed. Rep. of Germany ..... 3112991

[51] Int. Cl.[3] ..... B24B 5/00

[52] U.S. Cl. ..... 51/49; 51/34 E; 51/165.72; 51/289 R; 324/226

[58] Field of Search ..... 51/49, 34 E, 35, 165 R, 51/165.72, 289 R, 165.71; 324/226

[56] References Cited

U.S. PATENT DOCUMENTS

| | | | |
|---|---|---|---|
| 3,321,869 | 5/1967 | Parrella | 51/49 |
| 3,616,578 | 11/1971 | Clark | 51/49 |
| 3,953,943 | 5/1976 | Nakaoka | 51/34 E |
| 4,112,626 | 9/1978 | Watanabe | 51/165.72 |
| 4,258,319 | 3/1981 | Shimada | 324/226 |

FOREIGN PATENT DOCUMENTS

| | | | |
|---|---|---|---|
| 2043300 | 10/1980 | United Kingdom | 51/165.71 |

*Primary Examiner*—Harold D. Whitehead
*Attorney, Agent, or Firm*—Horst M. Kasper

[57] ABSTRACT

A method and apparatus are provided for controlled grinding of roller surfaces. A rotary drive rotates a roller and a grinding wheel is rotated, which has a rotation axis parallel to the axis of the roller. The rotating grinding wheel is pressed against the rotating roller at a certain position along the axis of the roller. The grinding wheel is moved along the direction of its axis. Simultaneously, the surface of the roller is tested with an eddy current test probe disposed substantially at a corresponding position along the axis of the roller as the grinding wheel, however, the eddy current test probe is staggered with respect to the grinding wheel by a suitable angle around the roller axis. The signals from the eddy current test probe are processed by an analog-digital converter and then by a digital processor.

25 Claims, 2 Drawing Figures

CONTROLLED GRINDING OF ROLLERS FOR ELIMINATION OF CRACKS

DESCRIPTION

BACKGROUND OF THE INVENTION

1. Field of the Invention

The present invention relates to a method and apparatus for the controlled grinding of rollers for the removal of cracks, where the roller is rotated in a rotating mechanism, while a rotating grinding wheel having an axis parallel to the axis of the roller is pressed against the the roller and is continuously or stepwise displaced linearly in the direction of the axis and where the cracks and the effect of the grinding are tested with an eddy current method.

2. Brief Description of the Background of the Invention Including Prior Art

Grinding devices and test apparatus employing eddy currents are known. The conventional methods employing these methods are associated with the disadvantage that they provide for either only grinding or only measuring. For measuring the grinding process always had to be interrupted and the eddy current test probe had to be positioned over the roller to be investigated. This method required considerable amounts of time. Frequently more than necessary material was ground off, since the number of measuring steps were reduced to a number as low as possible because of the time expenditure involved in the measurement.

SUMMARY OF THE INVENTION

1. Purposes of the Invention

It is an object of the present invention to provide a method which allows to obtain test results during the ongoing grinding process.

It is a further object of the present invention to provide a method which continuously allows to look at a total view over the state of the complete roller and over the advancing grinding process after each grinding passage.

It is another object of the present invention to provide an apparatus suitable for cooperative grinding and testing of rollers with possible defects in their surface.

These and other objects and advantages of the present invention will become evident from the description which follows.

2. Brief Description of the Invention

The present invention provides a method for controlled grinding of roller surfaces which comprises rotating the roller with a rotary drive, rotating a grinding wheel having a rotation axis disposed about parallel to the rotation axis of the roller, pressing the rotating grinding wheel against the rotating roller at a certain position along the axis of the roller, moving the grinding wheel along the direction of its axis, testing the surface of the roller with an eddy current test probe disposed substantially at the same position along the axis of the roller as the grinding wheel, however, which eddy current test probe is staggered with respect to the grinding wheel by a suitable angle relative to the center axis of the grinding wheel and performing the testing while the grinding wheel is rotating and interacting with the roller, and processing the signals from the eddy current test probe.

The test results can be displayed as to successive partial sectors of the roller to the operator. The sectors can correspond to subdivision lines of the roller surface substantially along lines parallel to the roller axis. Furthermore, the sectors can correspond to subdivision lines of the roller surface disposed substantially within planes vertical to the roller axis. The sectors can be displayed successively in the circumferential direction of the roller and next to each other in a direction parallel to the roller axis.

The test results can be classified into defect groupings and the defect groupings can be displayed. A drive for the grinding wheel position can be controlled according to the defect grouping determinations. The display values can be stored in a memory and the values before passage of the grinding wheel along the roller surface can be compared with values after passage of the grinding wheel. The surface of the roller can be tested for cracks with the eddy current test probe.

In one aspect of the present invention there is provided an apparatus for controlled grinding of roller surfaces which comprises a grinding wheel, a drive for the support to move the support in a direction substantially parallel to the direction of the axis of the grinding wheel, a rotatable roller disposed with its axis about parallel to the axis of the grinding wheel, an eddy current test probe disposed on an eddy current test probe arm and adapted to test the surface of the roller.

Two support wheels can be mounted on the eddy current test probe arm and be disposed on both sides of the eddy current test probe in a direction about parallel to the axis of the roller for providing proper relative positioning of the eddy current test probe with respect to the roller surface. The wheels on the eddy current test probe arm can be rolls. The axis of the wheels can be about parallel to the axis of the roller and follow about a straight line. Alternatively, the axis of the wheels can be slightly inclined with respect to the axis of the roller, where the incline is such that the wheel is adapted to follow the motion of the support in its contact path on the roller surface. There can be provided a contact pressure element for pressing the wheels disposed on the eddy current test probe arm against the roller and providing a sliding support in a radial direction relative to the roller. The contact pressure element can be an air cylinder. A pulling off means can be provided for removing the eddy current test probe from the roller. A hinge means is preferred for removing the eddy current test probe from the roller by tilting. A rotary connection can be disposed between the measurement arm and the eddy current test probe arm for turning the eddy current test probe away from the roller.

A processor can be employed for processing the data coming from the eddy current test probe. An eddy current test instrument can be connected to the eddy current test probe, an analog digital converter can be connected to the eddy current test instrument, a digital processor can be connected to the analog digital converter, a device for subdividing the circumference of the roller can be connected to the digital processor and a device for subdividing the length of the roller can be connected to the digital processor.

The device for subdividing the circumference of the roller and the device for subdividing the length of the roller can provide a different electrical signal for every section of the roller above which the eddy current test probe is disposed.

A picture screen can be connected to the digital processor for coordinating at least a part of the roller surface with all sectors positively conforming to the surface of the picture screen.

A memory can be connected to the digital processor for providing the possibility of recalling to the picture screen the data produced at the last or next to last grinding passage or processed results entered from the digital processor. A drive controlling the position of the grinding wheel can allow for moving the grinding wheel relative to the roller surface.

Means can be provided for elastically supporting the wheels on the eddy current test probe arm in a radial direction relative to the rotation axis of the roller and preferably the means for elastically supporting does not allow a tilting around an axis which is orthogonal to the axis of the roller and within the tangential contact plane of the wheels and the roller surface in order to avoid canting of the support rollers.

A drive can be provided for controlling the position of the grinding wheel, a processor can process the data coming from the eddy current test probe and a connection from the processor to the drive can allow for disengaging the grinding wheel from the roller surface upon meeting of a preset standard by the test signals coming from the eddy current test probe.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention.

DESCRIPTION OF INVENTION AND PREFERRED EMBODIMENTS

Figure 1:
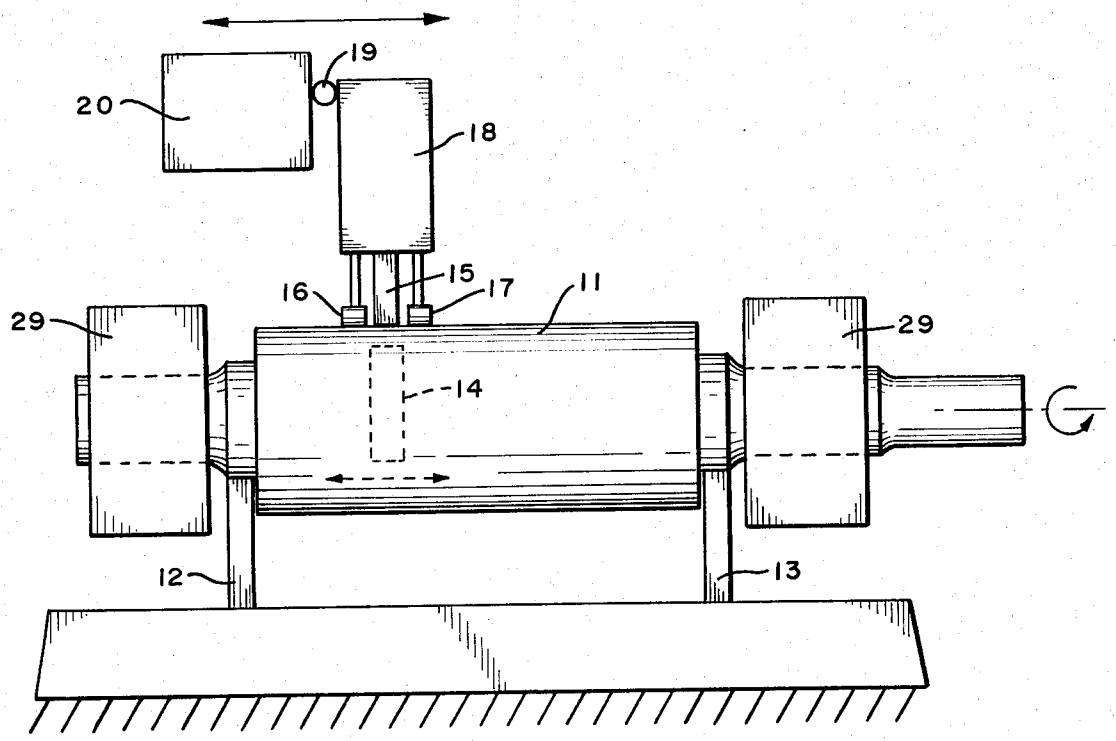
FIG. 1 is a schematic side elevational view of the roller disposed in the rotary apparatus with the measurement head at the top with test probe arm and measurement arm and with the grinding wheel located behind the roller.
Figure 2:
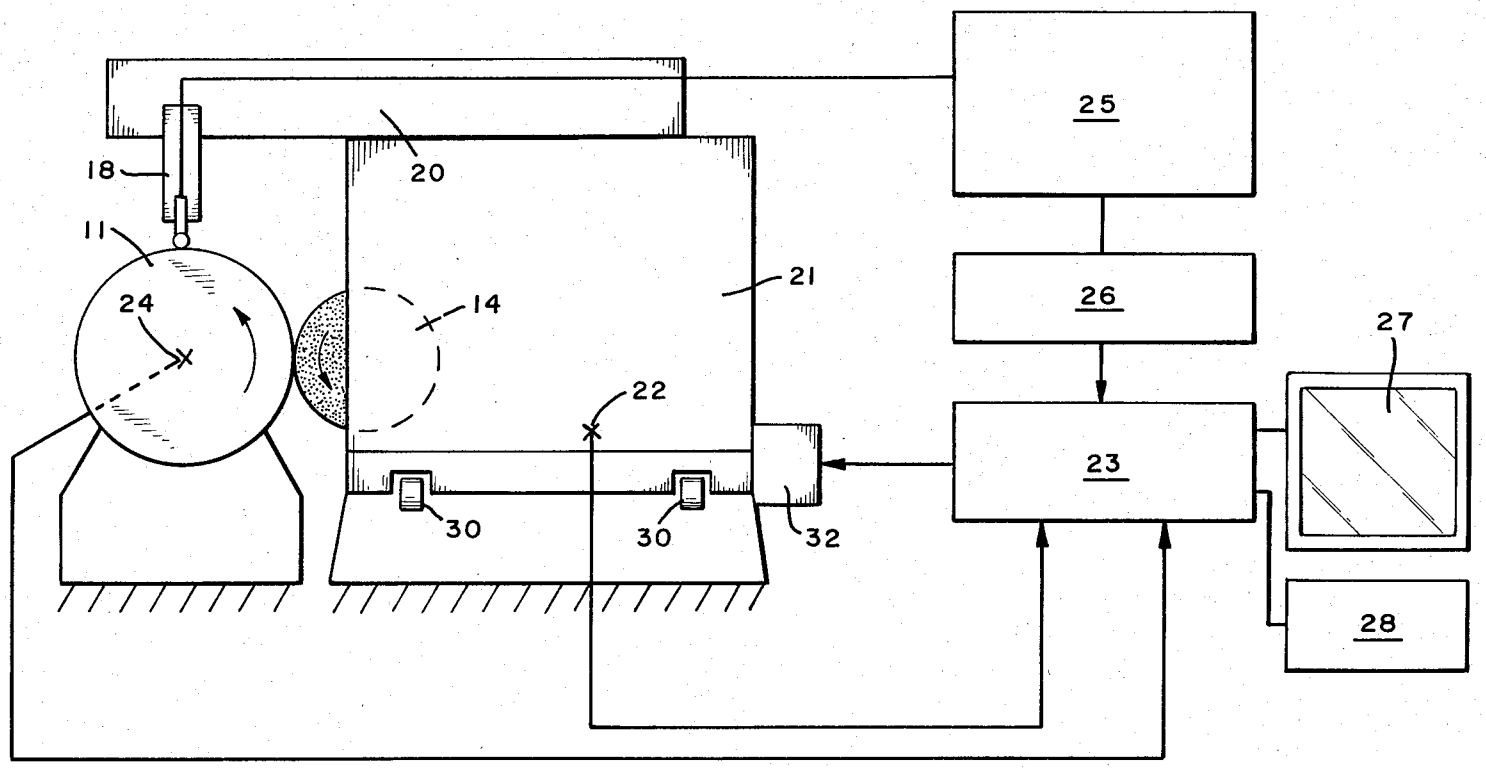
FIG. 2 is a schematic sectional view of the connections from the probe and the guiding of the grinding wheel to the processing apparatus, the display screen and to the printer.

In accordance with the present invention there is provided an eddy current test apparatus for the determination of cracks at the surface of the section of the roller, which is opposite to the lateral position of the grinding wheel, which test apparatus is applied to the roller during the grinding process and which separates the measurement data in successive partial surfaces and displays the same to the operator of the grinding wheel. Further, several cracks disposed in succession in the direction of the circumference are determined, if the partial surfaces are displayed as successively situated in the circumferential direction of the roller. It is also possible that the surfaces disposed neighboringly in axial direction are displayed. A capturing of all defects and a good total view can be achieved by displaying the partial surfaces in circumferential direction of the roller successively and in axial direction as neighbors.

The display becomes more clear, if the measurement results are not given as absolute values but are coordinated to defect classes, which in turn are displayed.

The effect of a one time grinding step can be recognized particularly easy in the case where the values of the display are stored and the values before the passage of the grinding wheel are compared with values after the performed grinding step. The process is advantageously performed with a device, where a measuring arm is connected to the support of the grinding wheel, which runs back and forth in the axial direction. The measuring arm runs in axial direction of the roller and the test probe of an eddy current test probe with a measurement head directed toward the roller is attached directly to the measuring arm or via an extension such as for example a probe arm.

The measurement head of the eddy current test apparatus is advantageously supported by the roller, if the measuring head is disposed about in the middle between two wheels or support rolls supported by the roller.

The distance of the measuring head from the roller remains the same even with different diameters of the roller, if the rotary axes of the wheels or support rolls are directed in parallel to the axis of the roller and are disposed along one line.

According to another embodiment it is also possible that the rotary axes of the wheels or support rolls are disposed slightly at an angle with respect to the axis of the roller, where the inclined position of the support rolls results in a component of the direction of motion parallel to the direction of the axis and directed in the direction of the motion of the support and where the rotation axis of the wheels is slightly displaced from a parallel position relative to the roller axis within a plane parallel to the contact plane of the roller and the wheel. Such an inclined position results in the advantage that no shifting forces from the side attack at the support rolls, since the support rolls in this case are tending by themselves to run along a helical path around the roller. However, upon reversal of the direction of grinding the disadvantage results that in this situation also the inclined position has to be reversed.

Differences in the diameter and unevenness are balanced by pressing the wheels or support rolls during operation by way of a contact pressure element such as for example a spring or cylinder against the roller and by disposing the wheels or support rolls radially shiftable with respect to the roller. The construction becomes particularly simple in case the contact pressure element is an air cylinder.

In order to position a heavey roller, for example with the aid of a crane, it becomes necessary that the test probe head can be pulled off from the roller or is attached by way of hinges. This is accomplished in the simplest way by providing between the measurement arm and the test probe arm a rotary connection for flapping the test probe away from the roller.

In order to coordinate the position of the cracks in the roller it is advantageous that a processing apparatus for the test data connected to the measurement head, which processing apparatus for example comprises an eddy current test device and a computer, is connected simultaneously to a device for subdividing the circumference of the roller and the length of the roller and that this device is connected such as to provide a different electrical signal for each subdivided section of the surface of the roller disposed closely adjacent to the measurement head.

The eddy current test probe can be provided by a probe comprising a coil which is powered by an electric oscillator. The electromagnetic field sets up losses in the roller caused by magnetic hysteresis in the material to be tested and/or by electrical eddy currents being set up. These losses reduce the output of the oscillator and thus give a measure of the properties of the roller surface region. The oscillator output signals are then processed.

Alternatively, it is possible to employ two coils in the eddy current test probe for performing the testing function, where one of the coils is exciting an electromagnetic field and where the second coil picks up the response and provides a signal to be processed.

The position of the cracks can be recognized best by having the processing apparatus connected to a display screen and by having a part of the surface or the total surface of the roller position conform to the roller surface coordinated to the face of the display screen. For comparing the effectiveness of the grinding process it is advantageous, if the processing apparatus comprises a storage for all test results occurring at least for example at the last and/or next to last passage of the grinding wheel at the roller surface or for all processed results, which is connected to the picture screen by a call-up device.

It is indispensable for the supporting of the support wheels, that they are disposed shiftable with respect to the direction toward the roller and that this support is fixed with regard to a rotation around a rotation axis, which is disposed vertical to the axis of the roller and which stands vertical to the direction of shifting of the support wheels against the roller.

Thus in accordance with the present invention an eddy current test probe apparatus 15 for determination of the cracks in the surface of a section of the roller 11 disposed opposite to the width of the grinding wheel 14 is applied during the grinding process and the test results are segregated for a subdivision of the roller surface into partial sectors and thus provided to the operator of the grinding apparatus.

The roller 11 is supported by the bearings 12 and 13 of the rotary device and is driven via shafts in a conventional manner. The grinding wheel is positioned in front of or behind the roller 11. The grinding wheel 14 is mounted at the support 21 and can be moved in a direction substantially toward the axis of the roller 11. The test probe 15 is kept at a small distance above the top surface of the roller 11. For maintaining the distance the support wheels 16 and 17 are provided and the rotation axis of the support wheels 16, 17 is in turn parallel or nearly parallel to the direction of the axis of the roller 11.

The measurement head which comprises the probe 15 and the support wheels 17 and 16 is supported via vertical shifts allowing guides at the probe arm 18 and is pressed elastically agains the roller 11 via an air cylinder not shown in the drawing. The support provided by the vertical shifts allowing guiding elements has to be very rigid against rotary motions, since upon reaching of the edge of the roller 11 only one support wheel 16, 17 is supported, however, the horizontal direction of the rotation axis of the support wheels 16, 17 nevertheless is to be maintained with regard to the axis of the roller 11.

The probe 15 is positioned with its middle about in the middle of the jacket section of the roller 11, which section is momentarily being ground down. The probe 15 can be narrower as compared with the grinding wheel 14. The probe arm 18 is connected to the measurement arm 20 via the support 19, such that the probe arm 18 can be flapped upward. A flapping upward is necessary before passage of the construction blocks 29 or other hindrances. The construction blocks 29 provide the support for the roller during rolling operation, which frequently during grinding procedures accompany the roller 11. A passage of at least one of these construction blocks 29 is required before the insertion or the removal of the roller from the supports 12 and 13. The measurement arm 20 running in a horizontal direction or approximately at a right angle to the axis of the roller 11 is connected to the grinding wheel 14 and is moved linearly along the roller 11 in correspondence with the grinding wheel 14. Based on the guides 30 the grinding wheel 14 can be moved along the longitudinal extension of the roller 11.

The position of the grinding wheel 14 in the longitudinal direction of the roller 11 is electrically tested by having a potentiometer or other distance pick-up 22 attached to the support 21, the position of which is changed in accordance to the distance passed over by the grinding wheel 14 along the roller 11, which is resulting in a proportional change of the voltage under the electrical current flows through the potentiometer 22. The potentiometer 22 is connected to a data processor 23. A second line of a further potentiometer 24 is also fed to the data processor 23. This potentiometer 24 rotates together with the roller 11 such that the current flowing through exhibits a voltage corresponding to the angle of rotation.

The measured pulse provided by the probe 15 upon passage of a crack is fed via a line to the eddy current test apparatus 25. This commercial instrument provides signal pulses upon the presence of cracks and the amplitude of the signal pulses is related to the depth of the crack corresponding to it. The eddy current test apparatus 25 is connected to the interface 26. The commercially available interface 26 transforms the signals from the eddy current test apparatus 25, which are provided as voltage pulses, into binary signals, which are coordinated to various classes of defects and which are fed to the digital processor. The digital processor 23 connects the evaluated test results to the signals from the two potentiometers 22 and 24.

Before providing this connection the signals from the potentiometers 22 and 24 are processed from the voltage changes as they are generated. For this purpose the voltage changes are coordinated to classes in the digital processor 23. Each class corresponds to a certain passed over distance by the potentiometer. In each case a class of the potentiometer 22 disposed on the support 21 is individually connected to each class of the potentiometer 24 and these values are stored in the digital processor successively in each case separately. The storage locations then correspond to the sections of the surface of the roller 11. The reference is to sections which are successively passed over upon rotation of the roller by the probe 15. Upon a linear shifting of the grinding wheel 14 along the roller 11 the next class of the potentiometer 22 disposed on the support 21 is individually connected to each class of the potentiometer 24 and these values are coordinated to the next row of storage locations in the digital processor. In this manner the values of the storage locations of the digital processor 23 correspond to small grid surfaces from the surface of the roller 11. Each evaluated test result from the probe 15 is coordinated to a storage location in the digital processor, which corresponds to the grid surface passed over during the measurement. These test results segregated according to grid positions and processed are made visible on a picture screen 27 connected to the digital processor 23 and the picture screen of the display apparatus is again corresponding to the surface of the roller 11 subdivided into grid surfaces, where the grid surfaces as to their relative position and number correspond to the grid surfaces into which the surface of the roller 11 is subdivided. Upon occurrence of a crack in the respective grid surface corresponding to the position of the crack a signal occurs on the picture screen, such as for example an A or a cross. If no crack is present, then the corresponding grid surface remains free. The digital processor can be programmed such that cracks of varying depth are represented by differing signs, for example cracks with a depth of less than 0.5 mm are represented by an A and cracks with a depth of over 0.5 mm are represented by a B.

The test results of each passage of the grinding wheel over a surface element of the roller 11 can be stored in memory 37 and can be recalled at any time from the memory 37 and by displayed on the picture screen or printed by a printer 28 and by compared with the results of the other grinding wheel passages over the roller 11.

The support 21 can be moved by a drive 32 in a direction parallel to the roller axis. The drive can be provided for example by an electric motor or by a hydraulic element. The drive 32 can be controlled by the digital processor 23. For example, if the processor 23 determines that the cracks as observed by the eddy current test probe are below a certain level, the motor of the support and the drive of the grinding wheel 14 can be interrupted automatically and the grinding wheel can be withdrawn and the rotation of the roller can be discontinued.

It will be understood that each of the elements described above, or two or more together, may also find a useful application in other types of system configurations and grinding process procedures differing from the type described above.

While the invention has been illustrated and described as embodied in the context of a roller grinding system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method for controlled grinding of roller surfaces comprising rotating a roller with a rotary drive;

rotating the grinding wheel having a rotation axis parallel to the rotation axis of the roller;

pressing the rotating grinding wheel against the rotating roller at a certain position along the axis of the roller;

moving the grinding wheel along the direction of its axis;

testing the surface of the roller with an eddy current test probe disposed at substantially the same position along the axis of the roller as the grinding wheel, however, staggered with respect to the grinding wheel by a suitable angle around the roller axis while the grinding wheel is rotating, mounting two support wheels having aligned axes on the eddy current test probe arm and disposed on each side of the eddy current test probe in a direction about parallel to the axis of the roller for providing proper relative positioning of the eddy current test probe with respect to the roller surface;

feeding a signal from the eddy current test probe to an eddy current test instrument;

converting an output from the eddy current test instrument with an analog-digital converter;

processing the signals from the eddy current test probe via an output of the analog-digital converter in a digital processor;

subdividing the circumference of the roller with a subdividing device connected to the digital processor;

subdividing the length of the roller with a subdividing device connected to the digital processor;

coordinating at least part of the roller surface with all sectors of said subdivided roller positively conforming to the surface of a picture screen connected to the digital processor.

2. The method for controlled grinding of roller surfaces according to claim 1 further comprising displaying the test results in successive partial sectors of the roller to the operator.

3. The method for controlled grinding of roller surfaces according to claim 2 wherein the sectors correspond to subdivision lines of the roller surface substantially along lines parallel to the roller axis.

4. The method for controlled grinding of roller surfaces according to claim 2 wherein the sectors correspond to subdivision lines of the roller surface disposed substantially within planes vertical to the roller axis.

5. The method for controlled grinding of roller surfaces according to claim 2 wherein the sectors are displayed successively in the circumferential direction of the roller and next to each other in a direction parallel to the roller axis.

6. The method for controlled grinding of roller surfaces according to claim 2 further comprising classifying the test results into defect groupings; and displaying the defect groupings.

7. The method for controlled grinding of roller surfaces according to claim 6 further comprising controlling a drive for the grinding wheel position according to the error grouping determinations.

8. The method for controlled grinding of roller surfaces according to claim 7 further comprising storing the display values in a memory; and comparing the values before passage of the grinding wheel along the roller surface with the values after passage of the grinding wheel.

9. The method for controlled grinding of roller surfaces according to claim 1 wherein the surface of the roller is tested for cracks by the eddy current test probe.

10. An apparatus for controlled grinding of roller surfaces comprising a grinding wheel;

a movable support for the grinding wheel;

a drive for the support to move the support in a direction substantially parallel to the direction of the axis of the grinding wheel;

a rotatable roller disposed with its axis about parallel to the axis of the grinding wheel and disposed to be engaged by the grinding wheel;

means for supporting the rotatable roller;

means for rotating said roller;

a measuring arm mounted on said grinding wheel support;

an eddy current test probe arm attached to the measuring arm;

an eddy current test probe disposed on the eddy current test probe arm in alignment with the plane of said grinding wheel and adapted to test the surface of the roller;

two support wheels having aligned axes and mounted on the eddy current test probe arm and disposed one on each side of the eddy current test probe in a direction about parallel to the axis of the roller providing proper relative positioning of the eddy current test probe with respect to the roller surface;

an eddy current test probe arm attached to the measuring arm;

an eddy current test probe disposed on the eddy current test probe arm and adapted to test the surface of the roller;

an eddy current test instrument connected to the eddy current test probe;

an analog-digital converter connected to the eddy current test instrument;

a digital processor connected to the analog-digital converter;

a device for subdividing the circumference of the roller connected to the digital processor;

a device for subdividing the length of the roller and connected to the digital processor; and a picture screen connected to the digital processor for coordinating at least a part of the roller surface with all sectors of said subdivided roller positively conforming to the surface of the picture screen.

11. The apparatus for controlled grinding of roller surfaces according to claim 10 wherein the wheels are rolls.

12. The apparatus for controlled grinding of roller surfaces according to claim 10 wherein the wheels have their axis about parallel to the axis of the roller and follow about a straight line.

13. The apparatus for controlled grinding of roller surfaces according to claim 10 wherein the wheels are slightly inclined with respect to the axis of the roller, where the incline is such that the wheel is adapted to follow the motion of the support in its contact path on the roller surface.

14. The apparatus for controlled grinding of roller surfaces according to claim 10 further comprising a contact pressure element for pressing the wheels disposed on eddy current test probe arm against the roller and providing a sliding support in a radial direction relative to the roller.

15. The apparatus for controlled grinding of roller surfaces according to claim 14 wherein the contact pressure element is an air cylinder.

16. The apparatus for controlled grinding of roller surfaces according to claim 10 further comprising pulling off means for removing the eddy current test probe from the roller.

17. The apparatus for controlled grinding of roller surfaces according to claim 10 further comprising hinge means for removing the eddy current test probe from the roller by tilting.

18. The apparatus for controlled grinding of roller surfaces according to claim 10 further comprising a rotary connection disposed between the measurement arm and the eddy current test probe arm for turning the eddy current test probe away from the roller.

19. The apparatus for controlled grinding of roller surfaces according to claim 10 wherein the device for subdividing the circumference of the roller and the device for subdividing the length of the roller provide a different electrical signal for every section of the roller above which the eddy current test probe is disposed.

20. The apparatus for controlled grinding of roller surfaces according to claim 10 further comprising a memory connected to the digital processor for providing a possibility of recalling to the picture screen the data produced at the last or next to last grinding passage or processed results entered from the digital processor.

21. The apparatus for controlled grinding of rollers according to claim 10 further comprising a drive controlling the position of the grinding wheel to allow moving the grinding wheel relative to the roller surface.

22. The apparatus for controlled grinding of rollers according to claim 10 further comprising means for electrically supporting the wheels on the eddy current test probe arm in a radial direction relative to the rotation axis of the roller and where the means for elastically supporting does not allow a tilting around and axis which is orthogonal to the axis of the roller and parallel to the tangential contact plane of the wheels and the roller surface in order to avoid canting of the support rollers.

23. The apparatus for controlled grinding of rollers according to claim 10 further comprising a drive controlling the position of the grinding wheel; a processor for processing the data coming from the eddy current test probe; and a connection from the processor to the drive to allow for disengaging the grinding wheel from the roller surface upon meeting of a preset standard by the test signals coming from the eddy current test probe.

24. The apparatus for the controlled grinding of rollers according to claim 10 wherein the grid surface of the screen corresponds to the positions on the roller; where the signals flowing from the digital processor to the screen comprise positional signals which are analog to the signals running from the device for subdividing the circumference of the roller and from the device for subdividing the length of the roller such that occurring defects at the roller surface are displayed on the screen corresponding in their relative position.

25. The apparatus for the controlled grinding of rollers according to claim 10 further comprising a printer connected to the digital processor for printing a representation of the surface of the roller.

* * * * *